US008791889B2

(12) United States Patent
Choi

(10) Patent No.: US 8,791,889 B2
(45) Date of Patent: Jul. 29, 2014

(54) PIXEL AND ORGANIC LIGHT EMITTING DISPLAY DEVICE USING THE SAME

(75) Inventor: Sang-Moo Choi, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1335 days.

(21) Appl. No.: 12/588,074

(22) Filed: Oct. 2, 2009

(65) Prior Publication Data

US 2010/0127955 A1 May 27, 2010

(30) Foreign Application Priority Data

Nov. 26, 2008 (KR) ..... 10-2008-0118054

(51) Int. Cl.
*G09G 3/32* (2006.01)

(52) U.S. Cl.
USPC ..... 345/82; 345/76; 345/206; 345/78; 345/77; 345/83; 345/204; 345/205; 345/690; 315/169.3

(58) Field of Classification Search
USPC ..... 345/76, 98, 82, 100, 205, 92, 204, 87, 345/85, 206; 315/169.3
See application file for complete search history.

(56) References Cited

U.S. PATENT DOCUMENTS

| | | | | |
|---|---|---|---|---|
| 6,858,991 | B2 * | 2/2005 | Miyazawa | 315/169.3 |
| 6,977,685 | B1 * | 12/2005 | Acosta-Serafini et al. | 348/308 |
| 7,224,334 | B2 * | 5/2007 | Choi et al. | 345/82 |
| 7,688,292 | B2 * | 3/2010 | Park et al. | 345/82 |
| 8,199,076 | B2 * | 6/2012 | Lin et al. | 345/76 |
| 2003/0132931 | A1 * | 7/2003 | Kimura et al. | 345/212 |
| 2006/0066532 | A1 * | 3/2006 | Jeong | 345/76 |
| 2006/0103324 | A1 | 5/2006 | Kim et al. | |
| 2006/0221662 | A1 * | 10/2006 | Park et al. | 365/145 |
| 2007/0164940 | A1 * | 7/2007 | Guo et al. | 345/76 |
| 2007/0262931 | A1 * | 11/2007 | Peng et al. | 345/76 |
| 2008/0007499 | A1 * | 1/2008 | Kawabe | 345/82 |
| 2008/0111804 | A1 | 5/2008 | Choi et al. | |
| 2008/0211397 | A1 | 9/2008 | Choi | |

FOREIGN PATENT DOCUMENTS

| | | | |
|---|---|---|---|
| KR | 10 2005-0109165 | A | 11/2005 |
| KR | 10 2005-0110941 | A | 11/2005 |
| KR | 10-2005-0110961 | A | 11/2005 |
| KR | 10-2006-0054603 | A | 5/2006 |
| KR | 10 2007-0071524 | A | 7/2007 |
| KR | 10-0815756 | B1 | 3/2008 |
| KR | 10-2008-0080753 | A | 9/2008 |
| KR | 10 2008-0082820 | A | 9/2008 |

* cited by examiner

*Primary Examiner* — Olga Merkoulova
(74) *Attorney, Agent, or Firm* — Lee & Morse, P.C.

(57) ABSTRACT

A pixel includes an organic light emitting diode, a first transistor configured to control a connection between a first power source and the organic light emitting diode, a second transistor configured to control a connection between a reference power source and the gate electrode of the first transistor, a third transistor, a fourth transistor, and a fifth transistor connected such that, when the third transistor, the fourth transistor, and the fifth transistor are all turned on, a data line is coupled to an anode electrode of the organic light emitting diode; and a storage capacitor having a first electrode coupled to the gate electrode of the first transistor and having a second electrode coupled to a common node between the third and fifth transistors, wherein the fourth transistor is configured to drop a voltage of a data signal on the data line by a threshold voltage of the fourth transistor.

22 Claims, 3 Drawing Sheets

PIXEL AND ORGANIC LIGHT EMITTING DISPLAY DEVICE USING THE SAME

BACKGROUND

1. Field

Embodiments relate to a pixel and an organic light emitting display device using the same.

2. Description of the Related Art

Recently, various flat panel display devices having reduced weight and volume, as compared to a cathode ray tube, have been developed. Such flat panel display devices include, e.g., a field emission display device, a plasma display device, an organic light emitting display device, etc.

An organic light emitting display device displays images by using an organic light emitting diode (OLED) generating light through recombination of electrons and holes. Such an organic light emitting diode may offer low power consumption and may have a rapid response speed.

However, the conventional organic light emitting display device may have a problem in that images having a uniform luminance may not be displayed due to a variation in threshold voltages of drive transistors in pixels of the display. In particular, when threshold voltages of the drive transistors in respective pixels are different from one another, the respective pixels may generate light having different luminances in response to a same data signal.

SUMMARY

Embodiments are directed to a pixel and an organic light emitting display device using the same, which substantially overcome one or more problems due to the limitations and disadvantages of the related art.

It is therefore a feature of an embodiment to provide a pixel and an organic light emitting display device using the same which may compensate for a threshold voltage variation of a driving transistor that controls an amount of current supplied to an organic light emitting diode.

At least one of the above and other features and advantages may be realized by providing a pixel, including an organic light emitting diode, first transistor configured to control a connection between a first power source and the organic light emitting diode, the first transistor having a gate electrode and controlling an amount of current supplied from the first power source to the organic light emitting diode in correspondence with a voltage at the gate electrode, a second transistor configured to control a connection between a reference power source and the gate electrode of the first transistor, a third transistor, a fourth transistor, and a fifth transistor connected such that, when the third transistor, the fourth transistor, and the fifth transistor are all turned on, a data line is coupled to an anode electrode of the organic light emitting diode, and a storage capacitor having a first electrode coupled to the gate electrode of the first transistor and having a second electrode coupled to a common node between the third and fifth transistors. The fourth transistor may be configured to drop a voltage of a data signal on the data line by a threshold voltage of the fourth transistor.

Each of the first, second, third, fourth, and fifth transistors may be an NMOS transistor.

Each of the second and third transistors may have a gate electrode controlled by a scan signal, the scan signal, when supplied, may have a voltage at which the second and third transistors are turned on, the fifth transistor may have a gate electrode controlled by a light emitting control signal, and the light emitting control signal, when supplied, may have a voltage at which the fifth transistor is turned off.

A first electrode of the third transistor may be coupled to the data line, the fourth transistor may be configured to control a connection between the third transistor and the common node, the fourth transistor may be diode-connected, a first electrode and a gate electrode of the fourth transistor both being coupled to a second electrode of the third transistor, and a second electrode of the fourth transistor may be coupled to the common node.

The fourth transistor may be configured to control a connection between the data line and a first electrode of the third transistor, the fourth transistor may be diode-connected, a first electrode and a gate electrode of the fourth transistor both being coupled to the data line, the fourth transistor may have a second electrode coupled to the first electrode of the third transistor, and a second electrode of the third transistor may be coupled to the common node.

A first electrode of the first transistor may be coupled to the first power source, a second electrode of the first transistor may be coupled to the anode electrode of the organic light emitting diode, a first electrode of the second transistor may be coupled to the reference power source, and a second electrode of the second transistor may be coupled to a common node between the first electrode of the storage capacitor and the gate electrode of the first transistor.

Each of the first, second, third, fourth, and fifth transistors may be an NMOS transistor, each of the second and third transistors may have a gate electrode controlled by a scan signal, the scan signal, when supplied, may have a voltage at which the second and third transistors are turned on, the fifth transistor may have a gate electrode controlled by a light emitting control signal, the light emitting control signal, when supplied, may have a voltage at which the fifth transistor is turned off, a first electrode of the third transistor may be coupled to the data line, the fourth transistor may be configured to control a connection between the third transistor and the common node, the fourth transistor may be diode-connected, a first electrode and a gate electrode of the fourth transistor both being coupled to a second electrode of the third transistor, and a second electrode of the fourth transistor may be coupled to the common node.

Each of the first, second, third, fourth, and fifth transistors may be an NMOS transistor, each of the second and third transistors may have a gate electrode controlled by a scan signal, the scan signal, when supplied, may have a voltage at which the second and third transistors are turned on, the fifth transistor may have a gate electrode controlled by a light emitting control signal, the light emitting control signal, when supplied, may have a voltage at which the fifth transistor is turned off, the fourth transistor may be configured to control a connection between the data line and a first electrode of the third transistor, the fourth transistor may be diode-connected, a first electrode and a gate electrode of the fourth transistor both being coupled to the data line, the fourth transistor may have a second electrode coupled to the first electrode of the third transistor, and a second electrode of the third transistor may be coupled to the common node.

At least one of the above and other features and advantages may be realized by providing an organic light emitting display device, including a scan driver sequentially supplying scan signals to scan lines so that transistors receiving the scan signals are turned on when the scan signals are supplied, and sequentially supplying light emitting control signals to light emitting control lines so that transistors receiving the light emitting control signals are turned off when the light emitting control signals are supplied, a data driver supplying data signals to the data lines when the scan signals are supplied, and pixels coupled to respective scan lines, light emitting control lines, and data lines. The pixels may each include an organic light emitting diode, a first transistor configured to control a connection between a first power source and the organic light emitting diode, the first transistor having a gate electrode and controlling an amount of current supplied from the first power source to the organic light emitting diode in correspondence with a voltage at the gate electrode, a second transistor configured to control a connection between a reference power source and the gate electrode of the first transistor, a third transistor, a fourth transistor, and a fifth transistor connected such that, when the third transistor, the fourth transistor, and the fifth transistor are all turned on, a data line is coupled to an anode electrode of the organic light emitting diode, and a storage capacitor having a first electrode coupled to the gate electrode of the first transistor and having a second electrode coupled to a common node between the third and fifth transistors. The fourth transistor may be configured to drop a voltage of a data signal on the data line by a threshold voltage of the fourth transistor.

A first electrode of the third transistor may be coupled to the data line, the fourth transistor may be configured to control a connection between the third transistor and the common node, the fourth transistor may be diode-connected, a first electrode and a gate electrode of the fourth transistor both being coupled to a second electrode of the third transistor, and a second electrode of the fourth transistor may be coupled to the common node.

The fourth transistor may be configured to control a connection between the data line and a first electrode of the third transistor, the fourth transistor may be diode-connected, a first electrode and a gate electrode of the fourth transistor both being coupled to the data line, the fourth transistor may have a second electrode coupled to the first electrode of the third transistor, and a second electrode of the third transistor may be coupled to the common node.

Each of the first, second, third, fourth, and fifth transistors may be an NMOS transistor.

The voltage of the reference voltage may be higher than that of the data signal.

The scan driver may supply a light emitting control signal to an i-th light emitting control line ("i" is a natural number) so that it overlaps with a scan signal supplied a corresponding i-th scan line.

Each of the second and third transistors may have a gate electrode controlled by a scan signal, the scan signal, when supplied, may have a voltage at which the second and third transistors are turned on, the fifth transistor may have a gate electrode controlled by a light emitting control signal, and the light emitting control signal, when supplied, may have a voltage at which the fifth transistor is turned off.

The light emitting control signal may have a first pulse having a first pulse width, the scan signal may have a second pulse having a second pulse width, and the first pulse width may be greater than the second pulse width.

The first pulse may begin before the second pulse begins, and the first pulse may end after the second pulse ends.

A first electrode of the first transistor may be coupled to the first power source, a second electrode of the first transistor may be coupled to the anode electrode of the organic light emitting diode, a first electrode of the second transistor may be coupled to the reference power source, and a second electrode of the second transistor may be coupled to a common node between the first electrode of the storage capacitor and the gate electrode of the first transistor.

Each of the first, second, third, fourth, and fifth transistors may be an NMOS transistor, each of the second and third transistors may have a gate electrode controlled by a scan signal, the scan signal, when supplied, may have a voltage at which the second and third transistors are turned on, the fifth transistor may have a gate electrode controlled by a light emitting control signal, the light emitting control signal, when supplied, may have a voltage at which the fifth transistor is turned off, a first electrode of the third transistor may be coupled to the data line, the fourth transistor may be configured to control a connection between the third transistor and the common node, the fourth transistor may be diode-connected, a first electrode and a gate electrode of the fourth transistor both being coupled to a second electrode of the third transistor, and a second electrode of the fourth transistor may be coupled to the common node.

Each of the first, second, third, fourth, and fifth transistors may be an NMOS transistor, each of the second and third transistors may have a gate electrode controlled by a scan signal, the scan signal, when supplied, may have a voltage at which the second and third transistors are turned on, the fifth transistor may have a gate electrode controlled by a light emitting control signal, the light emitting control signal, when supplied, may have a voltage at which the fifth transistor is turned off, the fourth transistor may be configured to control a connection between the data line and a first electrode of the third transistor, the fourth transistor may be diode-connected, a first electrode and a gate electrode of the fourth transistor both being coupled to the data line, the fourth transistor may have a second electrode coupled to the first electrode of the third transistor, and a second electrode of the third transistor may be coupled to the common node.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION

Figure 1:
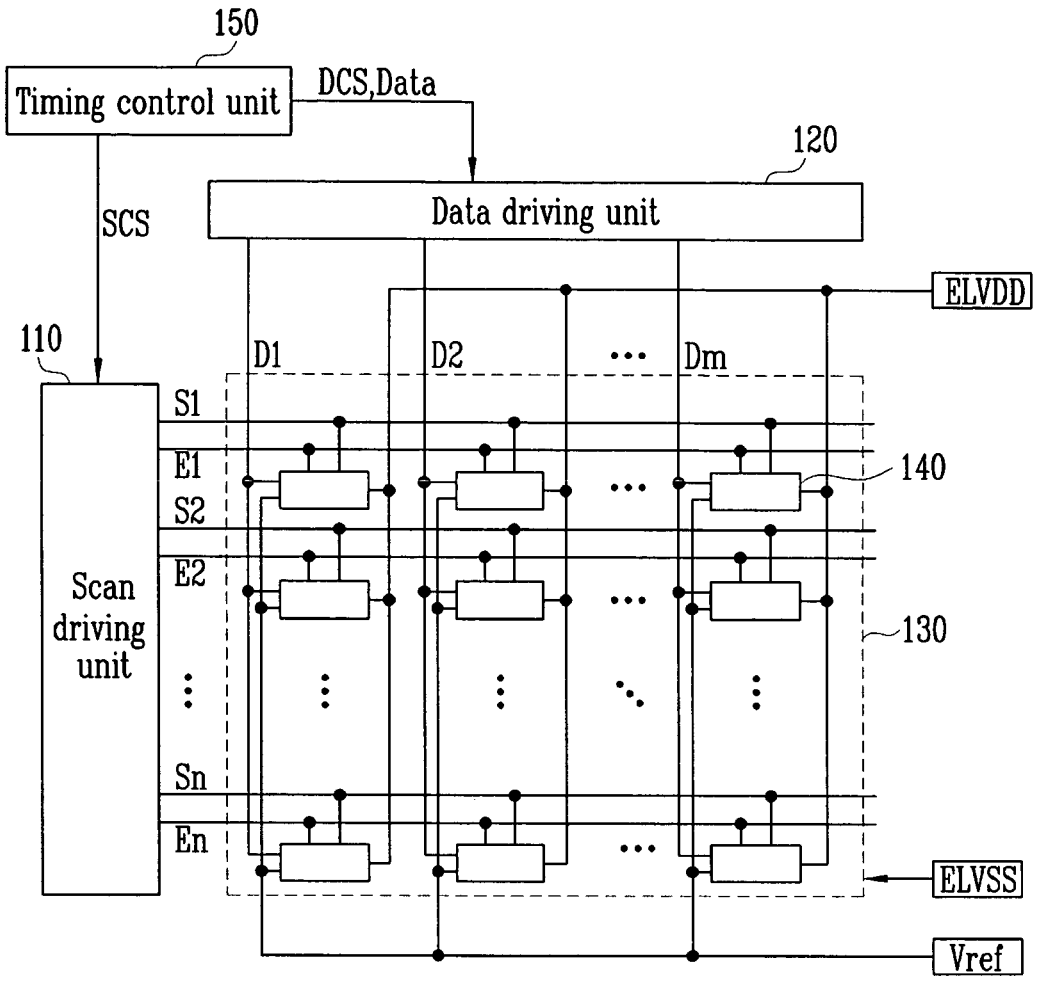
FIG. 1 illustrates a block diagram of an organic light emitting display device according to an embodiment.

Korean Patent Application No. 10-2008-0118054, filed on Nov. 26, 2008, in the Korean Intellectual Property Office, and entitled: "Pixel and Organic Light Emitting Display Device Using the Same," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the drawings, the dimensions of regions may be exaggerated for clarity of illustration. Like reference numerals refer to like elements throughout.

Herein, when a first element is described as being coupled to a second element, the first element may be directly coupled to the second element, or may be indirectly coupled to the second element via a third element. In the drawings, details of elements that are not essential to the complete understanding of the invention may be omitted for clarity.

FIG. 1 illustrates a block diagram of an organic light emitting display device according to an embodiment.

Referring to FIG. 1, the organic light emitting display device may include pixels 140 positioned to be respectively coupled to scan lines S1 to Sn, light emitting control lines E1 to En, and data lines D1 to Dm. The organic light emitting display device may also include a scan driver 110 driving the scan lines S1 to Sn and the light emitting control lines E1 to En, a data driver 120 driving the data lines D1 to Dm, and a timing control unit 150 controlling the scan driver 110 and the data driver 120.

Figure 3:
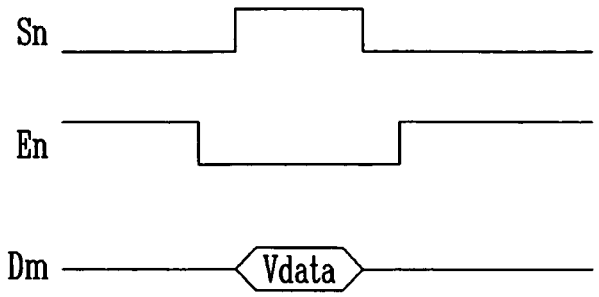
FIG. 3 illustrates a waveform driving the pixel of FIG. 2.

The scan driver 110 may receive a scan driving control signal SCS that is supplied from the timing control unit 150. The scan driver 110 receiving the scan driving control signal SCS supplied from the timing control unit 150 may generate a scan signal, and may sequentially supply the generated scan signal to the scan lines S1 to Sn. The scan driver 110 may generate a light emitting control signal, and may sequentially supply the light emitting control signal to the light emitting control lines E1 to En. When supplied, the scan signal may be set as a voltage at which transistors can be turned on. For example, the scan signal may be set as a high polarity voltage when it is supplied, and when transistors gated by, i.e., controlled by, the scan signal are NMOS transistors. When supplied, the light emitting control signal may be set as a voltage at which transistors can be turned off. For example, the light emitting control signal may be set as a low polarity voltage when it is supplied, and when transistors gated by, i.e., controlled by, the light emitting control signal are NMOS transistors. As shown in FIG. 3, the light emitting control signal may be supplied as a pulse having a pulse width, e.g., a duration of a low polarity pulse, that is greater, i.e., wider; than a pulse width, e.g., a duration of a high polarity pulse, of the scan signal when the scan signal is supplied. A light emitting control signal supplied through an i-th ("i" is a natural number) light emitting control line E1 may be supplied to overlap with a scan signal supplied through an i-th scan line S1. For example, for corresponding lines E1 and S1, the light emitting control signal pulse may be low while the corresponding scan pulse is high. In an implementation, the pulse of the light emitting control signal may begin before the pulse of the scan signal begins, and the pulse of the light emitting control signal may end after the pulse of the scan signal ends.

Referring again to FIG. 1, the data driver 120 may receive a data driving control signal DCS supplied from the timing control unit 150. The data driver 120 receiving the data driving control signal DCS supplied from the timing control unit 150 may supply data signals to the data lines D1 to Dm in synchronization with the scan signal.

The timing control unit 150 may generate the data driving control signal DCS and the scan driving control signal SCS in response to synchronization signals supplied from an external source. The data driving control signal DCS generated from the timing control unit 150 may be supplied to the data driver 120, and the scan driving control signal SCS generated from the timing control unit 150 may be supplied to the scan driver 110. The timing control unit 150 may supply data Data, the data Data being supplied from an external source, to the data driver 120.

A pixel unit 130 may receive power from a first power source ELVDD and a second power source ELVSS. The pixel unit 130 may also receive power from a reference power source Vref, which may be external. The pixel unit 130 may supply ELVDD, ELVSS, and Vref to each of the pixels 140. Each of the pixels 140 receiving the first power source ELVDD, the second power source ELVSS, and the reference power source Vref may generate light in response to a data signal. In an implementation, each of the pixels 140 includes a plurality of transistors formed of a same conductivity type. For example, each transistor in each pixel 140 may be an NMOS type transistor.

In an implementation, the voltage of the first power source ELVDD may be set higher than the voltage of the second power source ELVSS. In an implementation, the voltage of the reference power source Vref may be set higher than the voltage of the data signal.

Figure 2:
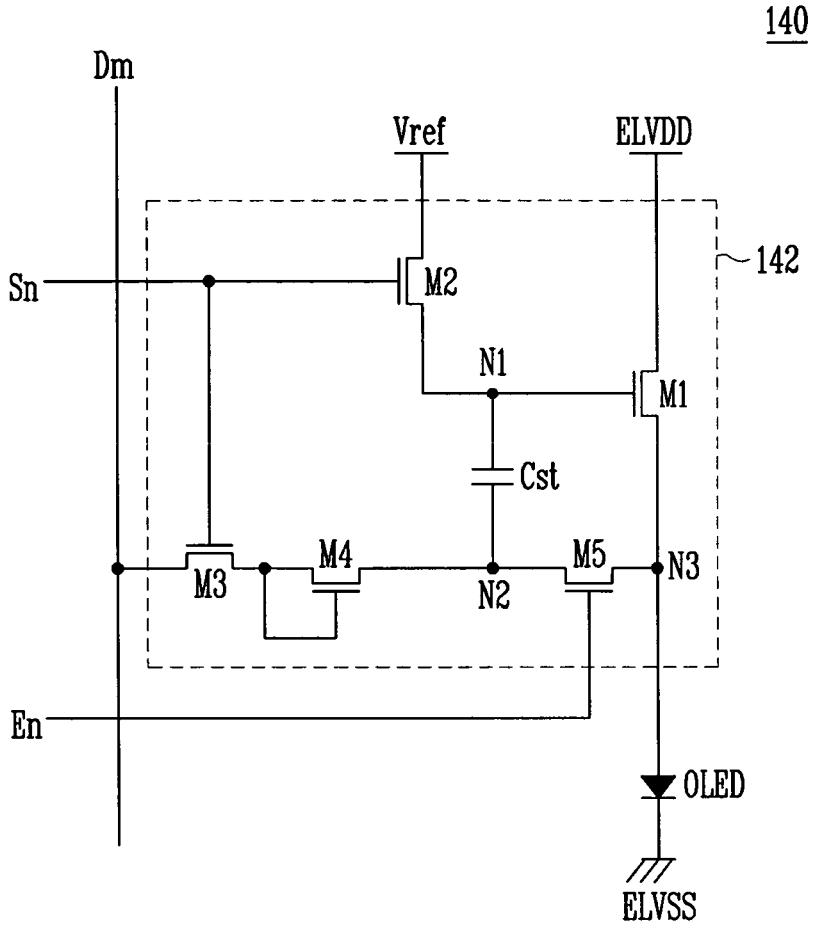
FIG. 2 illustrates a first embodiment of a pixel of FIG. 1.

FIG. 2 illustrates a first embodiment of a pixel of in FIG. 1. For convenience of explanation, FIG. 2 shows a pixel 140 coupled to an n-th scan line Sn, an n-th light emitting control line, and an m-th data line Dm.

Referring to FIG. 2, a pixel 140 according to the first embodiment may include an organic light emitting diode OLED and a pixel circuit 142 coupled to the data line Dm, the scan line Sn, and the light emitting control line En. The pixel circuit 142 may control an amount of current flowing through the organic light emitting diode OLED.

An anode electrode of the organic light emitting diode OLED may be coupled to the pixel circuit 142, and a cathode electrode of the organic light emitting diode OLED may be coupled to the second power source ELVSS. The organic light emitting diode OLED may generate light having a predetermined luminance in correspondence with an amount of current supplied from the pixel circuit 142.

When a scan signal is supplied to the pixel circuit 142 through the scan line Sn, the pixel circuit 142 may receive a data signal supplied from the data line Dm and may supply current corresponding to the data signal to the organic light emitting diode OLED. The pixel circuit 142 may include first to fifth transistors M1 to M5 and a storage capacitor Cst. In an implementation, the first to fifth transistors M1 to M5 may each be NMOS transistors.

A gate electrode of the first transistor M1 may be coupled to a first node N1, and a first electrode of the first transistor M1 may be coupled to the first power source ELVDD. A second electrode of the first transistor M1 may be coupled to the anode electrode of the organic light emitting diode OLED. The first transistor M1 may control an amount of current that flows from the first power source ELVDD to the second power source ELVSS via the organic light emitting diode OLED, in correspondence with a voltage applied to the first node N1.

A gate electrode of the second transistor M2 may be coupled to the scan line Sn, and a first electrode of the second transistor M2 may be coupled to the reference power source Vref. A second electrode of the second transistor M2 may be coupled to the first node N1. When a scan signal is supplied to the second transistor M2 through the scan line Sn, e.g., when the scan line Sn goes high, the second transistor M2 may be turned on to supply the voltage of the reference power source Vref to the first node N1.

A gate electrode of the third transistor M3 may be coupled to the scan line Sn, and a first electrode of the third transistor M3 may be coupled to the data line Dm. When a scan signal is supplied to the third transistor M3 through the scan line Sn, e.g., when the scan line Sn goes high, the third transistor M3 may be turned on. The second transistor M2 and the third transistor M3 may turn on at the same time and may turn off at the same time.

A first electrode and the gate electrode of the fourth transistor M4 may both be coupled to a second electrode of the third transistor M3. The fourth transistor M4 may be diode-connected so that current can flow from the second electrode of the third transistor M3 to the second node N2 when a voltage in excess of the threshold voltage of the fourth transistor M4 is applied to the first electrode and gate electrode thereof. A second electrode of the fourth transistor M4 may be coupled to a second node N2. The voltage of the signal supplied by the fourth transistor M4 to the second node N2 may be reduced, i.e., dropped, by an amount that is the same as the threshold voltage of the fourth transistor M4.

A gate electrode of the fifth transistor M5 may be coupled to the light emitting control line En, and a first electrode of the fifth transistor M5 may be coupled to a third node N3. The third node N3 may be coupled to the anode electrode of the organic light emitting diode OLED. A second electrode of the fifth transistor M5 may be coupled to the second node N2. When a light emitting control signal is supplied to the fifth transistor M5 through the light emitting control line En, e.g., when the light emitting control line En goes low, the fifth transistor M5 may be turned off. When the light emitting control signal is not supplied to the fifth transistor M5 through the light emitting control line En, e.g., when the light emitting control line is high, the fifth transistor M5 may be turned on.

The storage capacitor Cst may be coupled between the first node N1 and the second node N2. Thus, the storage capacitor Cst may have a first electrode coupled to the gate electrode of the first transistor M1, and may have a second electrode coupled to a point between the fourth transistor M4 and the fifth transistor M5. A predetermined voltage may be charged into the storage capacitor Cst in response to a data signal.

FIG. 3 illustrates a waveform driving the pixel of FIG. 2. In the waveform diagram for driving the pixel, Vdata in FIG. 3 refers to a voltage of a data signal.

Operations of the pixel will be described below in detail in conjunction with FIGS. 2 and 3. First, a light emitting control signal may be supplied through the light emitting control signal En, e.g., the light emitting control line En may go low, and the fifth transistor M5 may be turned off.

After the light emitting control line voltage changes, e.g., goes low, as a result of the light emitting control signal, a scan signal may be supplied through the scan line Sn. When the scan signal is supplied through the scan line Sn, e.g., when the scan line Sn goes high, the second and third transistors M2 and M3 may each be turned on. When the second transistor M2 is turned on, the reference voltage Vref may be supplied to the first node N1. When the third transistor M3 is turned on, a voltage obtained by subtracting a threshold voltage of the fourth transistor M4 from a voltage Vdata of the data signal may be supplied to the second node N2. Thus, the voltage supplied to the second node N2 may be supplied via the diode-connected fourth transistor M4 and, accordingly, the voltage at the second node N2 may be set as the voltage obtained by subtracting the threshold voltage of the fourth transistor M4 from the voltage Vdata of the data signal.

The voltage of the reference voltage Vref supplied to the first node N1 may be set higher than that of the data signal. When the reference voltage Vref is supplied to the first node N1, the first transistor M1 may be turned on. When the first transistor M1 is turned on, a predetermined current may be supplied to the organic light emitting diode OLED. In this case, a voltage of ELVSS+Voled may be applied to the third node N3. The Voled refers to a voltage applied to the organic light emitting diode OLED corresponding to the predetermined current.

Next, the supply of the scan signal to the scan line Sn may then be stopped, e.g., the scan line Sn may go low, and the second and third transistors M2 and M3 may each be turned off Subsequently, the supply of the light emitting control signal to the light emitting control line En may be stopped, e.g., the light emitting control line En may go high, and the fifth transistor M5 may be turned on.

When the fifth transistor M5 is turned on, the voltage at the second node N2 may be changed by an amount $\Delta V_{N2}$ as set forth by Equation 1, below.

$$\Delta V_{N2} = V\text{data} - V\text{th}(M4) - (ELVSS + V\text{oled}) \quad \text{[Equation 1]}$$

In Equation 1, $\Delta V_{N2}$ denotes the voltage variation at the second node N2, and Vth(M4) denotes a threshold voltage of the fourth transistor M4.

When the voltage at the second node N2 is changed as shown in Equation 1, the voltage at the first node N1 may be changed by coupling of the storage capacitor Cst as set forth in Equation 2, below.

$$\Delta V_{N1} = V\text{ref} - \Delta V_{N2} = V\text{ref} - V\text{data} + V\text{th}(M4) + ELVSS + V\text{oled} \quad \text{[Equation 2]}$$

Therefore, the voltage between the gate and source electrodes of the first transistor M1 (Vgs_M1) is determined based on Equation 3, below.

$$V\text{gs_}M1 = V\text{ref} - V\text{data} + V\text{th}(M4) + ELVSS + V\text{oled} - (ELVSS + V\text{oled}) = V\text{ref} - V\text{data} + V\text{th}(M4) \quad \text{[Equation 3]}$$

In this case, current flowing through the first transistor M1 can be determined based on Equation 4.

$$I\text{oled} = \beta \times (V\text{ref} - V\text{data})^2 \quad \text{[Equation 4]}$$

In Equation 4, Ioled denotes current flowing through the organic light emitting diode OLED, and β denotes a constant value. Equation 4 is a numerical expression obtained when assuming that the threshold voltage of the fourth transistor M4 is equal to that of the first transistor M1. Practically, since the threshold voltages of the first and fourth transistors M1 and M3 positioned in the same pixel are roughly set equal to each other, the current flowing through the organic light emitting diode OLED can be set based on Equation 4.

Referring to Equation 4 and pixel circuit 142 in FIG. 3, the current flowing through the organic light emitting diode OLED may be determined by the reference voltage Vref and the voltage Vdata of the data signal. Thus, a desired current may be supplied to the organic light emitting diode OLED regardless of the threshold voltage variation of the first transistor M1. Accordingly, variations in Vth_M1 may be compensated by the pixel circuit 142.

Figure 4:
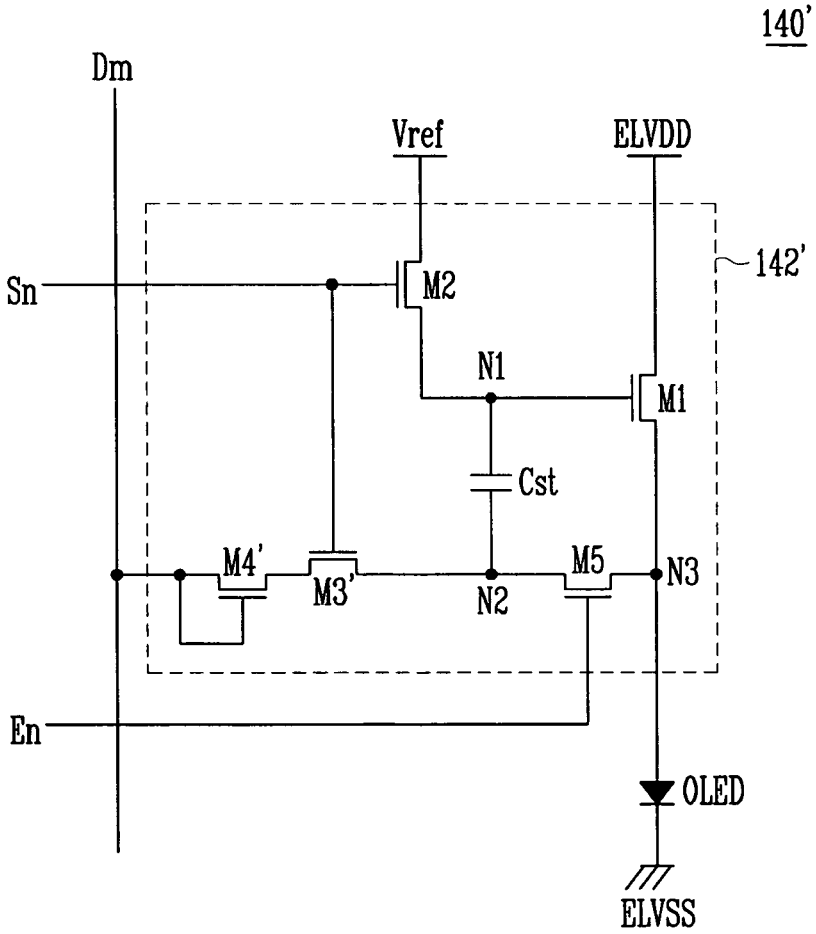
FIG. 4 illustrates a second embodiment of a pixel of FIG. 1.

FIG. 4 illustrates a second embodiment of a pixel of FIG. 1. In FIG. 4, elements identical to those of FIG. 2 are provided with the same reference numerals, and the detailed description of such elements will not be repeated.

Referring to FIG. 4, the pixel 140' according to the second embodiment may include an organic light emitting diode OLED and a pixel circuit 142' coupled to the data line Dm, the emission control line En, and the scan line Sn. The pixel circuit 142' may control an amount of current flowing through the organic light emitting diode OLED.

The anode electrode of the organic light emitting diode OLED may be coupled to the pixel circuit 142', and the cathode electrode of the organic light emitting diode OLED may be coupled to the second power source ELVSS. The organic light emitting diode OLED may generate light having a predetermined luminance in correspondence with an amount of current supplied from the pixel circuit 142'.

When a scan signal is supplied to the pixel circuit 142' through the scan line Sn, the pixel circuit 142' may receive a data signal supplied through the data line Dm and may supply an amount of current corresponding to the data signal to the organic light emitting diode OLED. The pixel circuit 142' may include first to fifth transistors M1, M2, M3', M4' and M5 and a storage capacitor Cst. In an implementation, the first to fifth transistors M1, M2, M3', M4' and M5 may each be a same conductivity type. In an implementation, the first to fifth transistors M1, M2, M3', M4' and M5 may each be NMOS transistors.

A first electrode and a gate electrode of the fourth transistor M4' may both be coupled to the data line Dm, and a second electrode of the fourth transistor M4' may be coupled to a first electrode of the third transistor M3'. The fourth transistor M4' may be diode-connected so that current can flow from the data line Dm to the first electrode of the third transistor M3'.

A gate electrode of the third transistor M3' may be coupled to the scan line Sn, and the first electrode of the third transistor M3' may be coupled to the second electrode of the fourth transistor M4'. A second electrode of the third transistor M3' is coupled to the second node N2. The second node N2 may be between the third transistor M3' and the first electrode of the fifth transistor M5. When a scan signal is supplied to the third transistor M3' through the scan line Sn, e.g., when the scan line Sn goes high, the third transistor M3' may be turned on.

As compared to the pixel 140 shown in FIG. 4, the pixel 140' shown in FIG. 2 may have the diode-connected fourth transistor M4' in a different position. The fourth transistor M4' may drop the voltage Vdata of a data signal by a threshold voltage of the fourth transistor M4', the dropped voltage being supplied to the third transistor M3'. The fourth transistor M4' may be coupled between the third transistor M3' and the data line Dm, as shown in FIG. 4, or between the third transistor M3' and the second node N2, as shown in FIG. 2. Operations of the other transistors M1, M2, M3', and M5 may be identical to those of the transistors M1, M2, M3, and M5 described above in connection with FIG. 1. Therefore, the detailed descriptions of the operations of the other transistors M1, M2, M3', and M5 will not be repeated.

As described above, embodiments may provide a pixel capable of compensating for a variation in threshold voltage of a driving transistor, and an organic light emitting display device using the same. Thus, images having uniform luminance may be displayed by compensating for the threshold voltage of the driving transistor.

Example embodiments have been disclosed herein, and although specific terms are employed, they are used and are to be interpreted in a generic and descriptive sense only and not for purpose of limitation. For example, the conductivity type of the transistors and the polarities of the signals may be changed. Accordingly, it will be understood by those of ordinary skill in the art that various changes in form and details may be made without departing from the spirit and scope of the present invention as set forth in the following claims.

What is claimed is:

1. A pixel, comprising:

an organic light emitting diode;

a first transistor configured to control a connection between a first power source and the organic light emitting diode, the first transistor having a gate electrode and controlling an amount of current supplied from the first power source to the organic light emitting diode in correspondence with a voltage at the gate electrode;

a second transistor configured to control a connection between a reference power source and the gate electrode of the first transistor;

a third transistor, a fourth transistor, and a fifth transistor connected such that, when the third transistor, the fourth transistor, and the fifth transistor are all turned on, a data line is coupled to an anode electrode of the organic light emitting diode; and a storage capacitor having a first electrode coupled to the gate electrode of the first transistor and having a second electrode coupled to a common node between the third and fifth transistors, wherein:

the fourth transistor is configured to drop a voltage of a data signal on the data line by a threshold voltage of the fourth transistor.

2. The pixel as claimed in claim 1, wherein each of the first, second, third, fourth, and fifth transistors is an NMOS transistor.

3. The pixel as claimed in claim 1, wherein:

a first electrode of the third transistor is coupled to the data line, the fourth transistor is configured to control a connection between the third transistor and the common node, the fourth transistor is diode-connected, a first electrode and a gate electrode of the fourth transistor both being coupled to a second electrode of the third transistor, a second electrode of the fourth transistor is coupled to the common node, and the third transistor, the fourth transistor, and the fifth transistor are the only transistors connecting the data line to the anode electrode of the organic light emitting diode.

4. The pixel as claimed in claim 1, wherein:

the fourth transistor is configured to control a connection between the data line and a first electrode of the third transistor, the fourth transistor is diode-connected, a first electrode and a gate electrode of the fourth transistor both being coupled to the data line, the fourth transistor has a second electrode coupled to the first electrode of the third transistor, a second electrode of the third transistor is coupled to the common node, and the third transistor, the fourth transistor, and the fifth transistor are the only transistors connecting the data line to the anode electrode of the organic light emitting diode.

5. The pixel as claimed in claim 1, wherein:

a first electrode of the first transistor is coupled to the first power source, a second electrode of the first transistor is coupled to the anode electrode of the organic light emitting diode, a first electrode of the second transistor is coupled to the reference power source, and a second electrode of the second transistor is coupled to a common node between the first electrode of the storage capacitor and the gate electrode of the first transistor.

6. The pixel as claimed in claim 1, wherein the fourth transistor is diode-connected.

7. The pixel as claimed in claim 2, wherein:

each of the second and third transistors has a gate electrode controlled by a scan signal, the scan signal, when supplied, has a voltage at which the second and third transistors are turned on, the fifth transistor has a gate electrode controlled by a light emitting control signal, and the light emitting control signal, when supplied, has a voltage at which the fifth transistor is turned off.

8. The pixel as claimed in claim 5, wherein:

each of the first, second, third, fourth, and fifth transistors is an NMOS transistor, each of the second and third transistors has a gate electrode controlled by a scan signal, the scan signal, when supplied, has a voltage at which the second and third transistors are turned on, the fifth transistor has a gate electrode controlled by a light emitting control signal, the light emitting control signal, when supplied, has a voltage at which the fifth transistor is turned off, a first electrode of the third transistor is coupled to the data line, the fourth transistor is configured to control a connection between the third transistor and the common node, the fourth transistor is diode-connected, a first electrode and a gate electrode of the fourth transistor both being coupled to a second electrode of the third transistor, and a second electrode of the fourth transistor is coupled to the common node.

9. The pixel as claimed in claim 5, wherein:

each of the first, second, third, fourth, and fifth transistors is an NMOS transistor, each of the second and third transistors has a gate electrode controlled by a scan signal, the scan signal, when supplied, has a voltage at which the second and third transistors are turned on, the fifth transistor has a gate electrode controlled by a light emitting control signal, the light emitting control signal, when supplied, has a voltage at which the fifth transistor is turned off, the fourth transistor is configured to control a connection between the data line and a first electrode of the third transistor, the fourth transistor is diode-connected, a first electrode and a gate electrode of the fourth transistor both being coupled to the data line, the fourth transistor has a second electrode coupled to the first electrode of the third transistor, and a second electrode of the third transistor is coupled to the common node.

10. An organic light emitting display device, comprising:

a scan driver sequentially supplying scan signals to scan lines so that transistors receiving the scan signals are turned on when the scan signals are supplied, and sequentially supplying light emitting control signals to light emitting control lines so that transistors receiving the light emitting control signals are turned off when the light emitting control signals are supplied;

a data driver supplying data signals to the data lines when the scan signals are supplied; and pixels coupled to respective scan lines, light emitting control lines, and data lines, wherein the pixels each include:

an organic light emitting diode, a first transistor configured to control a connection between a first power source and the organic light emitting diode, the first transistor having a gate electrode and controlling an amount of current supplied from the first power source to the organic light emitting diode in correspondence with a voltage at the gate electrode, a second transistor configured to control a connection between a reference power source and the gate electrode of the first transistor, a third transistor, a fourth transistor, and a fifth transistor connected such that, when the third transistor, the fourth transistor, and the fifth transistor are all turned on, a data line is coupled to an anode electrode of the organic light emitting diode, and a storage capacitor having a first electrode coupled to the gate electrode of the first transistor and having a second electrode coupled to a common node between the third and fifth transistors, wherein:

the fourth transistor is configured to drop a voltage of a data signal on the data line by a threshold voltage of the fourth transistor.

11. The organic light emitting display device as claimed in claim 10, wherein:

a first electrode of the third transistor is coupled to the data line, the fourth transistor is configured to control a connection between the third transistor and the common node, the fourth transistor is diode-connected, a first electrode and a gate electrode of the fourth transistor both being coupled to a second electrode of the third transistor, a second electrode of the fourth transistor is coupled to the common node, and the third transistor, the fourth transistor, and the fifth transistor are the only transistors connecting the data line to the anode electrode of the organic light emitting diode.

12. The organic light emitting display device as claimed in claim 10, wherein:

the fourth transistor is configured to control a connection between the data line and a first electrode of the third transistor, the fourth transistor is diode-connected, a first electrode and a gate electrode of the fourth transistor both being coupled to the data line, the fourth transistor has a second electrode coupled to the first electrode of the third transistor, a second electrode of the third transistor is coupled to the common node, and the third transistor, the fourth transistor, and the fifth transistor are the only transistors connecting the data line to the anode electrode of the organic light emitting diode.

13. The organic light emitting display device as claimed in claim 10, wherein each of the first, second, third, fourth, and fifth transistors is an NMOS transistor.

14. The organic light emitting display device as claimed in claim 10, wherein the voltage of the reference voltage is higher than that of the data signal.

15. The organic light emitting display device as claimed in claim 10, the scan driver supplies a light emitting control signal to an i-th light emitting control line ("i" is a natural number) so that it overlaps with a scan signal supplied a corresponding i-th scan line.

16. The organic light emitting display device as claimed in claim 10, wherein:

a first electrode of the first transistor is coupled to the first power source, a second electrode of the first transistor is coupled to the anode electrode of the organic light emitting diode, a first electrode of the second transistor is coupled to the reference power source, and a second electrode of the second transistor is coupled to a common node between the first electrode of the storage capacitor and the gate electrode of the first transistor.

17. The organic light emitting display device as claimed in claim 10, wherein the fourth transistor is diode-connected.

18. The organic light emitting display device as claimed in claim 15, wherein:

each of the second and third transistors has a gate electrode controlled by a scan signal, the scan signal, when supplied, has a voltage at which the second and third transistors are turned on, the fifth transistor has a gate electrode controlled by a light emitting control signal, and the light emitting control signal, when supplied, has a voltage at which the fifth transistor is turned off.

19. The organic light emitting display device as claimed in claim 15, wherein:

the light emitting control signal has a first pulse having a first pulse width, the scan signal has a second pulse having a second pulse width, and the first pulse width is greater than the second pulse width.

20. The organic light emitting display device as claimed in claim 19, wherein:

the first pulse begins before the second pulse begins, and the first pulse ends after the second pulse ends.

21. The organic light emitting display device as claimed in claim 16, wherein:

each of the first, second, third, fourth, and fifth transistors is an NMOS transistor, each of the second and third transistors has a gate electrode controlled by a scan signal, the scan signal, when supplied, has a voltage at which the second and third transistors are turned on, the fifth transistor has a gate electrode controlled by a light emitting control signal, the light emitting control signal, when supplied, has a voltage at which the fifth transistor is turned off, a first electrode of the third transistor is coupled to the data line, the fourth transistor is configured to control a connection between the third transistor and the common node, the fourth transistor is diode-connected, a first electrode and a gate electrode of the fourth transistor both being coupled to a second electrode of the third transistor, and a second electrode of the fourth transistor is coupled to the common node.

22. The organic light emitting display device as claimed in claim 16, wherein:

each of the first, second, third, fourth, and fifth transistors is an NMOS transistor, each of the second and third transistors has a gate electrode controlled by a scan signal, the scan signal, when supplied, has a voltage at which the second and third transistors are turned on, the fifth transistor has a gate electrode controlled by a light emitting control signal, the light emitting control signal, when supplied, has a voltage at which the fifth transistor is turned off, the fourth transistor is configured to control a connection between the data line and a first electrode of the third transistor, the fourth transistor is diode-connected, a first electrode and a gate electrode of the fourth transistor both being coupled to the data line, the fourth transistor has a second electrode coupled to the first electrode of the third transistor, and a second electrode of the third transistor is coupled to the common node.

* * * * *